US009366495B1

(12) United States Patent
Coppinger et al.

(10) Patent No.: US 9,366,495 B1
(45) Date of Patent: Jun. 14, 2016

(54) NOISE SUPPRESSOR FOR FIREARM

(71) Applicant: Thunder Beast Arms Corporation, Cheyenne, WY (US)

(72) Inventors: Michael S. Coppinger, Cheyenne, WY (US); Kurtis A. Palu, Fort Collins, CO (US)

(73) Assignee: Thunder Beast Arms Corporation, Cheyenne, WY (US)

( * ) Notice: Subject to any disclaimer, the term of this patent is extended or adjusted under 35 U.S.C. 154(b) by 0 days.

(21) Appl. No.: 14/615,826

(22) Filed: Feb. 6, 2015

(51) Int. Cl.
*F41A 21/30* (2006.01)
*B23P 15/00* (2006.01)

(52) U.S. Cl.
CPC *F41A 21/30* (2013.01); *B23P 15/00* (2013.01)

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 4,576,083 | A | 3/1986 | Seberger, Jr. | |
| 4,907,488 | A | 3/1990 | Seberger | |
| 5,433,133 | A | 7/1995 | La France | |
| 6,948,415 | B2 | 9/2005 | Matthews et al. | |
| 7,062,874 | B1 | 6/2006 | Smith | |
| 7,237,467 | B1 | 7/2007 | Melton | |
| 7,308,967 | B1 * | 12/2007 | Hoel | 181/223 |
| D582,502 | S | 12/2008 | Brittingham | |
| D582,503 | S | 12/2008 | Brittingham | |
| D584,786 | S | 1/2009 | Brittingham | |
| D584,787 | S | 1/2009 | Brittingham | |
| D585,518 | S | 1/2009 | Brittingham | |
| D591,382 | S | 4/2009 | Brittingham | |
| 7,587,969 | B2 | 9/2009 | Silvers | |
| 7,588,122 | B2 | 9/2009 | Brittingham | |
| 7,594,464 | B2 | 9/2009 | Dueck | |
| 7,600,606 | B2 | 10/2009 | Brittingham | |
| 7,610,710 | B2 | 11/2009 | Brittingham | |
| 7,610,992 | B2 | 11/2009 | Brittingham | |
| 7,661,349 | B1 | 2/2010 | Brittingham | |
| 7,676,976 | B2 | 3/2010 | Dueck et al. | |
| 7,743,693 | B1 | 6/2010 | Brittingham | |
| 7,789,009 | B1 | 9/2010 | Brittingham | |
| 7,856,914 | B2 | 12/2010 | Shults et al. | |
| 7,874,238 | B2 | 1/2011 | Silvers | |
| 7,891,282 | B1 | 2/2011 | DeGroat | |
| 7,905,171 | B1 | 3/2011 | Brittingham | |
| 7,946,069 | B2 | 5/2011 | Dueck et al. | |

(Continued)

FOREIGN PATENT DOCUMENTS

| | | | |
|---|---|---|---|
| WO | WO 97/07375 | A2 | 2/1997 |
| WO | WO 2011/035111 | A1 | 3/2011 |

OTHER PUBLICATIONS

U.S. Appl. No. 14/816,321; NonFinal Office Action dated Feb. 22, 2016; 17 pages.

*Primary Examiner* — Forrest M Phillips
(74) *Attorney, Agent, or Firm* — Swanson & Bratschun, L.L.C.

(57) ABSTRACT

Novel durable, lightweight, and accurate noise suppressors to attach to firearms comprised of components made of dissimilar materials, as well as methods to create the same. Disclosed embodiments include using a threaded interface between components made of dissimilar materials to increase the strength of the interface between such components in order to improve the durable of the noise suppressor and the accuracy of the firearm.

17 Claims, 4 Drawing Sheets

(56) References Cited

U.S. PATENT DOCUMENTS

| | | | | |
|---|---|---|---|---|
| D639,375 | S | 6/2011 | Oliver | |
| D642,648 | S | 8/2011 | Oliver | |
| D642,649 | S | 8/2011 | Oliver | |
| D642,650 | S | 8/2011 | Oliver | |
| D643,087 | S | 8/2011 | Oliver | |
| 7,987,944 | B1 | 8/2011 | Brittingham et al. | |
| 8,087,338 | B1 | 1/2012 | Hines | |
| 8,091,462 | B2 | 1/2012 | Dueck et al. | |
| 8,096,222 | B2 | 1/2012 | Silvers | |
| 8,100,224 | B1 | 1/2012 | Olson | |
| 8,162,100 | B2 | 4/2012 | Shults et al. | |
| 8,167,084 | B1 | 5/2012 | Moore | |
| 8,196,701 | B1 | 6/2012 | Oliver | |
| 8,201,487 | B2 | 6/2012 | Dueck et al. | |
| 8,209,895 | B2 | 7/2012 | Dueck et al. | |
| 8,272,306 | B1 | 9/2012 | Smith | |
| 8,286,750 | B1 | 10/2012 | Oliver | |
| D677,357 | S | 3/2013 | Dueck et al. | |
| 8,387,299 | B1 | 3/2013 | Brittingham et al. | |
| 8,397,862 | B2 | 3/2013 | Shand | |
| 8,424,441 | B2 | 4/2013 | Brittingham et al. | |
| D682,974 | S | 5/2013 | Honigmann | |
| D682,975 | S | 5/2013 | Honigmann | |
| 8,439,155 | B2 | 5/2013 | Shults et al. | |
| D683,806 | S | 6/2013 | Dueck | |
| 8,453,789 | B1 * | 6/2013 | Honigmann et al. | 181/223 |
| 8,459,405 | B1 | 6/2013 | Dueck | |
| 8,459,406 | B1 | 6/2013 | Dueck | |
| 8,474,361 | B2 | 7/2013 | Brittingham | |
| 8,490,535 | B1 | 7/2013 | Moore et al. | |
| 8,505,431 | B2 | 8/2013 | Hines | |
| 8,505,680 | B2 | 8/2013 | Dueck | |
| 8,516,941 | B1 | 8/2013 | Oliver | |
| 8,539,708 | B2 | 9/2013 | Kenney et al. | |
| 8,555,765 | B2 | 10/2013 | Graham et al. | |
| 8,567,556 | B2 | 10/2013 | Dueck et al. | |
| 8,579,075 | B2 | 11/2013 | Brittingham et al. | |
| 8,584,794 | B2 | 11/2013 | Dueck | |
| 8,714,301 | B2 * | 5/2014 | Shults | 181/223 |
| 8,739,922 | B2 | 6/2014 | Wirth et al. | |
| 8,763,510 | B2 | 7/2014 | Dueck et al. | |
| 8,770,084 | B2 | 7/2014 | Young | |
| 8,826,793 | B2 | 9/2014 | Oliver | |
| 8,939,057 | B1 * | 1/2015 | Edsall | 89/14.05 |
| 8,950,546 | B2 | 2/2015 | Shults et al. | |
| 8,973,481 | B2 * | 3/2015 | Dueck et al. | 89/14.4 |
| 8,991,551 | B2 * | 3/2015 | Latka | 181/223 |
| 2012/0103176 | A1 * | 5/2012 | Latka | 89/14.4 |
| 2012/0272818 | A1 | 11/2012 | Dueck et al. | |
| 2014/0059913 | A1 | 3/2014 | Diamond et al. | |
| 2014/0318887 | A1 | 10/2014 | Latka | |
| 2016/0109205 | A1 | 4/2016 | Coppinger et al. | |

* cited by examiner

NOISE SUPPRESSOR FOR FIREARM

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a firearm noise suppressor containing components made of dissimilar materials, and more particularly, to a firearm noise suppressor in which components, including end caps and baffles, are manufactured from dissimilar materials in order to optimize the weight, strength, and durability of such components and where adjacent components made of dissimilar materials are connected using a threaded interface.

BACKGROUND

In order to fire a projectile, a firearm utilizes an ignited propellant to create a high-pressure pulse of hot gases behind the projectile to force the projectile down the barrel of the firearm. When the high-pressure gases exit the barrel of the firearm, they generate a loud noise, commonly referred to as a "muzzle blast." Noise suppressors are commonly used with firearms, such as rifles and handguns, to reduce muzzle blast. To reduce muzzle blast, suppressors attach to the end of the firearm barrel and allow the high-pressure gases to expand, and thereby dissipate pressure, before exiting the firearm. By allowing the pressure behind the projectile to dissipate before exiting the firearm, a firearm suppressor can significantly reduce muzzle blast.

In order to allow the high-pressure gases to expand before exiting the firearm, a noise suppressor creates a significantly larger volume than exists in the firearm barrel. Noise suppressors can create this larger volume through a series of chambers, which are often referred to as "baffles." The size and number of baffles needed to effectively dissipate the high-pressure gases behind the projectile vary depending on a number of factors including without limitation the caliber and barrel length of the firearm as well as the type of ammunition used. To effectively suppress muzzle blast in certain firearms, noise suppressors often utilize a significant number of baffles to create the volume necessary to allow the high-pressure gases to sufficiently dissipate before exiting the firearm. However, increasing the number and size of the baffles utilized in the noise suppressor increases the weight of the firearm, which can have a negative impact on the firearm's performance. While lighter metals can be used to decrease the weight of the suppressor, suppressor designs utilizing lighter metals typically lack sufficient strength and durability. Suppressors made from dissimilar materials also have additional durability problems because components made of dissimilar materials cannot be effectively welded together and are either held together by an outer tube or by press/interference fits that often weaken over time and allow the components to rattle against one another. When components of suppressor rattle against one another, they create additional noise and reduce the accuracy of the firearm.

Accordingly, there is a need for a lighter and more durable noise suppressor that effectively suppresses muzzle blast and maintains the accuracy of the firearm.

BRIEF SUMMARY

Certain embodiments include durable, lightweight, and accurate noise suppressors as well as tools and techniques to create the same. In an aspect of particular embodiments, a noise suppressor comprises components, such as baffles and end caps, made of dissimilar materials that are designed to minimize the weight of the suppressor while also providing adequate strength and durability of the components within the suppressor. More specifically, certain components of a noise suppressor can comprise titanium, which is a relatively lightweight metal, where other components are made of stainless steel that offers greater strength and durability than titanium. While components made of the same material can often be effectively connected using various welding techniques, components made of dissimilar materials are typically difficult to weld reliably. Therefore, particular embodiments include using a threaded interface between components made of dissimilar materials to increase the strength of the interface between such components in order to maintain the strength of the noise suppressor and the accuracy of the firearm.

In certain embodiments, the noise suppressor has an end cap at the proximal end of the suppressor that has a threaded interface that connects to the barrel of a firearm. The proximal end cap can also connect to a muzzle break, flash suppressor, or other device that attaches to the barrel of a firearm. The proximal end cap is made of a material comprising titanium. The noise suppressor comprises first and second baffles made of a material comprising stainless steel. Each first and second baffle comprises a proximal end that includes a substantially hemispherical dome and a distal end that includes a spacer. The baffles can also include a conical face instead of a substantially hemispherical dome and, in some cases, the spacer may be a separate component from the baffle. In between the substantially hemispherical dome and spacer of the first baffle is a threaded interface that is used to connect the first baffle to the proximal end cap. The first baffle connects to the second baffle utilizing a welded interface. The noise suppressor also comprises a third, fourth and fifth baffle made of a material comprising titanium. Each third, fourth, and fifth baffle comprises a proximal end that includes a substantially hemispherical dome and a distal end that includes a spacer. In between the substantially hemispherical dome and spacer of the third baffle is a threaded interface that is used to connect the third baffle to the second baffle. The noise suppressor also comprises a sixth baffle made of material comprising titanium and comprises a proximate end that includes a substantially hemispherical dome and a distal end. The noise suppressor also comprises an end cap made of a material comprising titanium and connects to the distal end of the sixth baffle utilizing a welded interface. The noise suppressor comprises an outer tube that encloses the baffles and connects to the proximal and distal end caps utilizing a welded interface.

Another set of embodiments include methods for manufacturing and assembling noise suppressors. By way of example, a proximal end cap comprising titanium is connected to a first baffle comprising stainless steel utilizing a threaded interface. A second baffle comprising stainless steel is connected to the first baffle. A third baffle comprising titanium is connected to the second baffle utilizing a thread interface. A fourth, fifth, and sixth baffle comprising titanium are respectively connected to the first and second baffle and form a "baffle stack." The interfaces between the following baffles are welded: first and second baffles, the third and fourth baffles, the fourth and fifth baffles, and the fifth and sixth baffles. The outer tube is slid over the baffle stack and abuts an interface on the proximal end cap. The distal end cap attaches to the distal end of the outer tube. The interfaces between the proximal end cap and the outer tube and the interface between the outer tube and the distal end cap are welded. Persons skilled in the art will appreciate that the steps of the discussed methods can vary and be performed in different sequences.

The embodiments of the invention described herein are defined by the claims. Further advantages and a more complete understanding of the embodiments will be apparent to persons skilled in the art from review following detailed description of various embodiments and appended claims.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION OF CERTAIN EMBODIMENTS

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present inventions may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Figure 1:
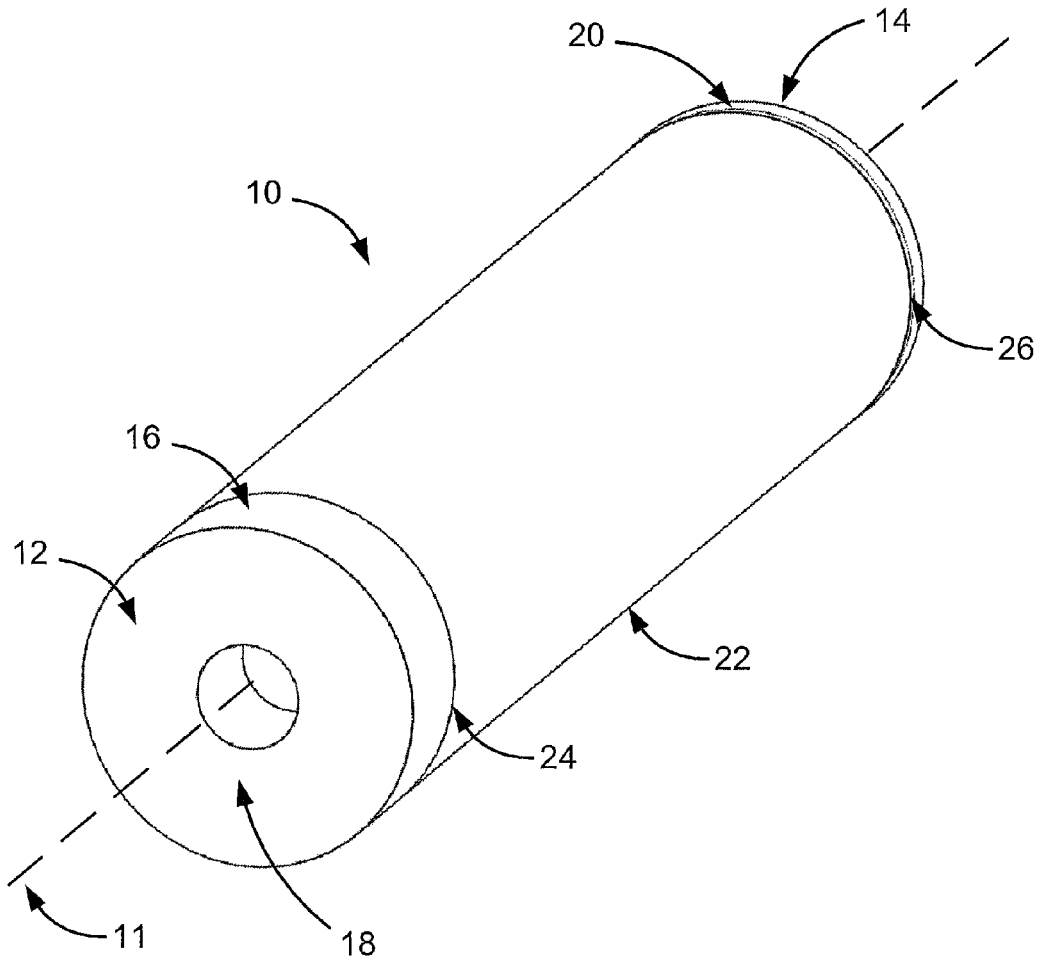
FIG. 1 shows a perspective view of an embodiment of the present invention.

FIG. 1 is a perspective view of an exemplary noise suppressor 10 in accordance with an embodiment of the present invention. As shown, the suppressor 10 includes central axis 11, a proximal end 12, and a distal end 14. As used in this detailed description, the term "proximal" is used to refer to the end of the component or element closest to the barrel of the firearm and the term "distal" is used to refer to the end of the component or element farthest from the barrel of the firearm. Suppressor 10 includes a proximal end cap 16 that attaches to the barrel of the firearm. In other embodiments, the proximal end cap can be modified to connect to a muzzle brake, flash suppressor, or other device that attaches to the barrel of a firearm. In this embodiment, the proximal end cap attaches to the firearm barrel using a threaded interface 18. Suppressor 10 also includes a distal end cap 20 and outer tube 22. In this embodiment, outer tube 22 attaches to proximal end cap 16 and distal end cap 20 at interfaces 24 and 26, respectively.

Figure 2:
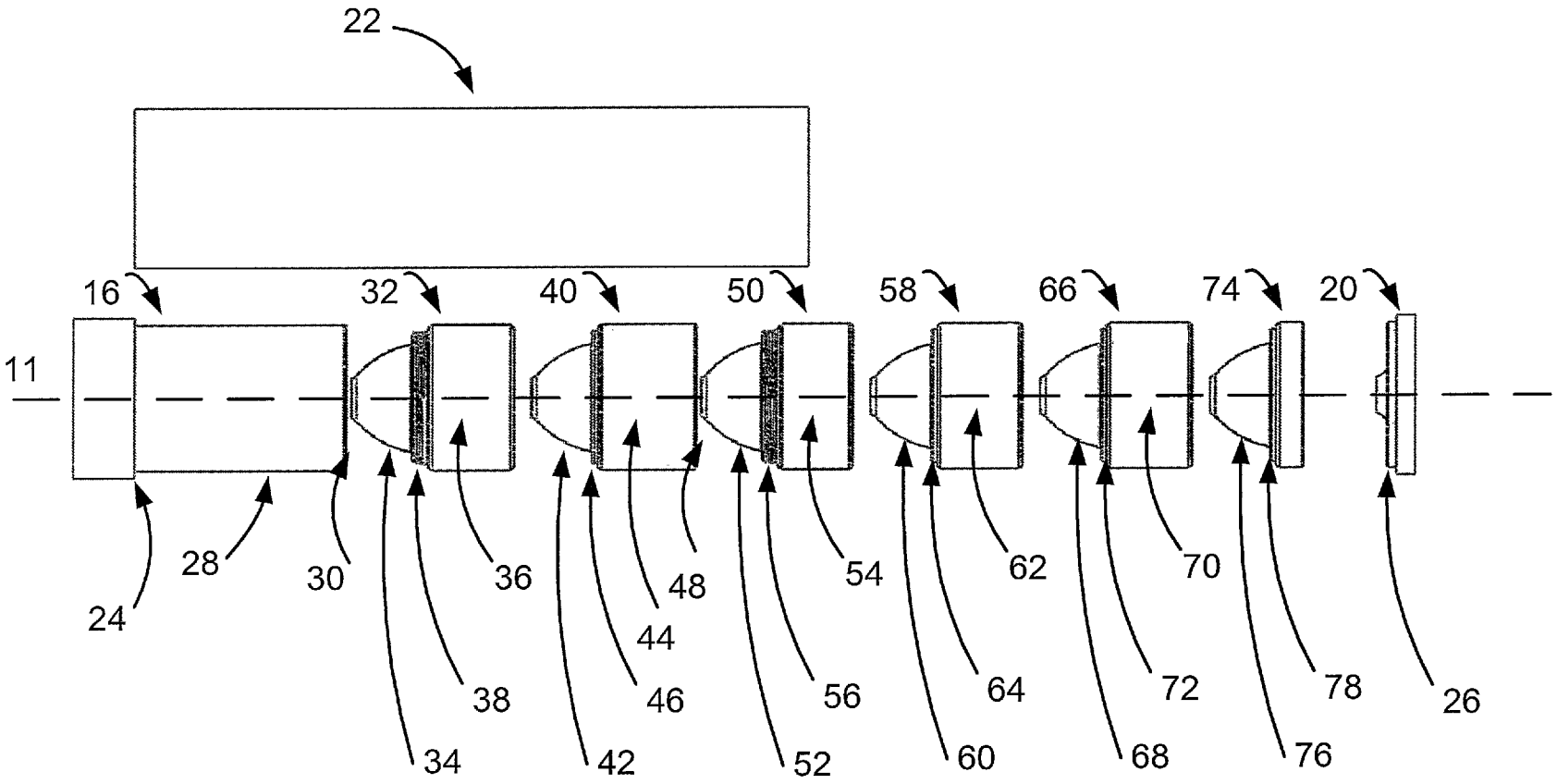
FIG. 2 shows an exploded side view of the noise suppressor of FIG. 1 with the outer tube removed.
Figure 3:
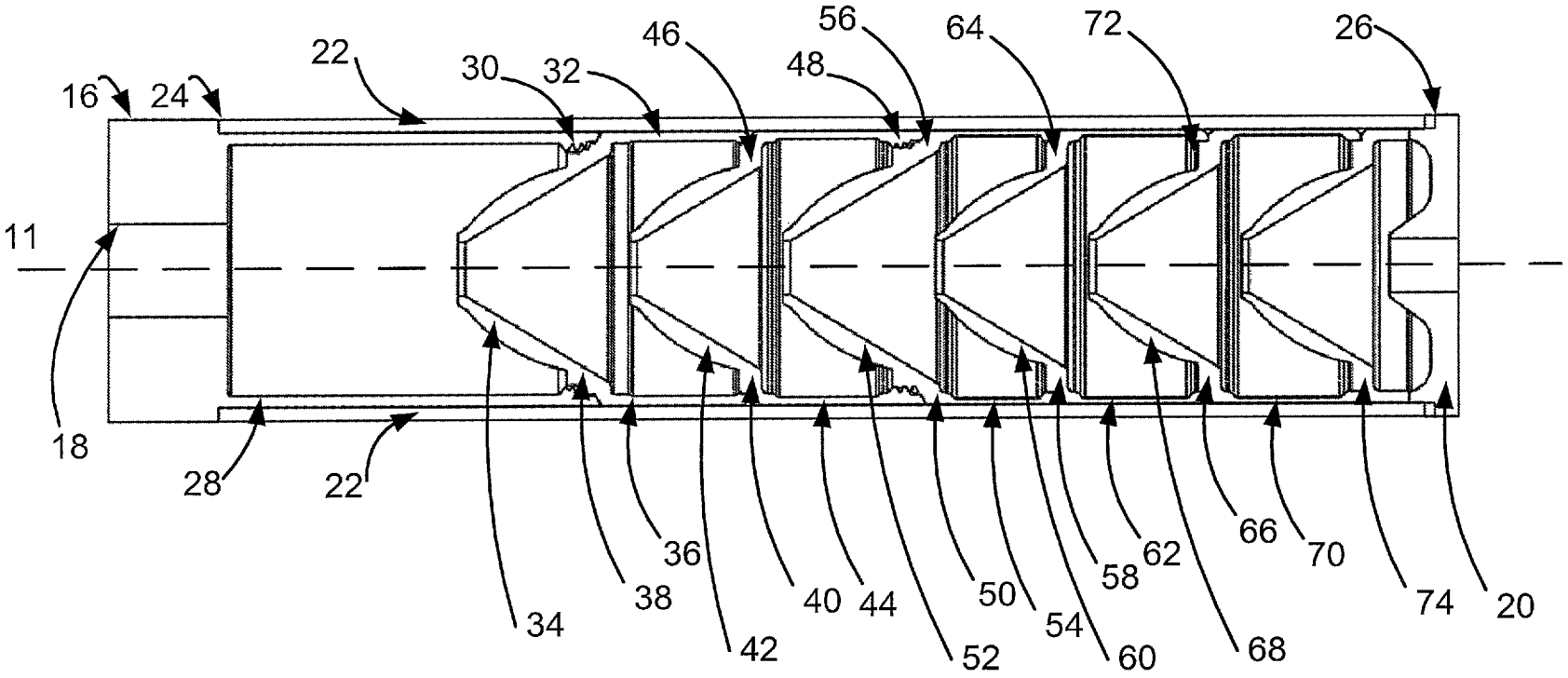
FIG. 3 shows a cross sectional view of the noise suppressor of FIG. 1.

FIG. 2 is an exploded side view of noise suppressor 10 as shown in FIG. 1 with outer tube 22 removed. FIG. 3 shows a cross sectional view of the noise suppressor of FIG. 1. As shown in FIGS. 2 and 3, the components of noise suppressor 10 are aligned along central axis 11 wherein each component has a bore at its proximal end aligned with central axis. Proximal end cap 16 includes threaded interface 18, which attaches to the barrel of the firearm that is not shown, and an internal tube 28. Outer tube 22 sides over internal tube 28 and is welded to proximal end cap 16 at interface 24. Proximal end cap 16 also includes an internal threaded interface 30 at its proximal end, which is shown in greater detail in FIG. 3. In this embodiment, proximal end cap 16 and outer tube 22 are made of a material comprising titanium.

As shown in FIGS. 2 and 3, noise suppressor 10 also includes first baffle 32, which includes a substantially hemispherical dome 34 at its proximal end and a spacer 36 at its distal end. Between the substantially hemispherical dome 32 and spacer 36 is threaded interface 38, which connects to threaded interface 30 of proximal end cap 16. In this embodiment, first baffle 32 is manufactured using a material comprising stainless steel. In this particular embodiment, proximal end cap 16 is connected to first baffle 32 by threading interface 38 of first baffle 32 into threaded interface 30 of proximal end cap 16.

Noise suppressor 10 includes second baffle 40 that includes a substantially hemispherical dome 42 at its proximal end, a spacer 44 at its distal end, an interface 46, and a threaded interface 48. Second baffle 40 is made of a material comprising stainless steel. In this particular embodiment, first baffle 32 is connected to second baffle 40 by welding interface 46 of second baffle 40 to the distal end of first baffle 32. Third baffle 50 includes a substantially hemispherical dome 52 at its proximal end, a spacer 54 at its distal end, and a threaded interface 56. Third baffle 50 is made of a material comprising titanium. In this particular embodiment, second baffle 40 is connected to third baffle 50 by threading interface 56 into threaded interface 48.

As shown in FIGS. 2 and 3, noise suppressor 10 also includes fourth baffle 58, which includes a substantially hemispherical dome 60 at its proximal end, a spacer 62 at its distal end, and an interface 64 between the substantially hemispherical dome 60 and spacer 62. Fourth baffle 58 is made of a material comprising titanium. In this particular embodiment, third baffle 50 is connected to fourth baffle 58 by welding interface 64 of fourth baffle 58 to the distal end of third baffle 50. Fifth baffle 66 includes a substantially hemispherical dome 68 at its proximal end, a spacer 70 at its distal end, and an interface 72 between the substantially hemispherical dome 68 and spacer 70. Fifth baffle 66 is made of a material comprising titanium. In this particular embodiment, fourth baffle 58 is connected to fifth baffle 66 by welding interface 72 of fifth baffle 66 to the distal end of fourth baffle 58. Sixth baffle 74 includes a substantially hemispherical dome 76 at its proximal end and an interface 78. Sixth baffle 74 is made of a material comprising titanium. In this particular embodiment, fifth baffle 66 is connected to sixth baffle 74 by welding interface 78 of sixth baffle 74 to the distal end of fifth baffle 66.

Once proximal end cap 16, first baffle 32, second baffle 40, third baffle 50, fourth baffle 58, fifth baffle 66, and sixth baffle 74 are interconnected to form a baffle stack, outer tube 22 is slide over the baffle stack and abuts with interface 24 of proximal end cap 16. As shown in FIGS. 2 and 3, noise suppressor 10 also comprises distal end cap 20. Distal end cap 20 is made of a material comprising titanium. Distal end cap 20 is secured to outer tube 22 by welding the two components together at interface 26 as shown in FIGS. 1-3.

As stated above, certain components of the embodiment of noise suppressor 10 depicted in FIGS. 2 and 3 are made from material comprising titanium and other components are made from material comprising stainless steel. Specifically, proximal end cap 16, distal end cap 20, outer tube 22, third baffle 50, fourth baffle 58, fifth baffle 66, and sixth baffle 74 can be made from titanium grade 2 or titanium grade 5 as defined by certain standards organizations such as the American Iron and Steel Institute ("AISI"), American Society of Testing and Materials ("ASTM"), or the Society of Automotive Engineers ("SAE"). First baffle 32 and second baffle 40 can be made from type 316 stainless steel as defined certain standards organizations such as AISI, ASTM, or SAE. Both titanium grade 2, titanium grade 5, and type 316 stainless steel are commercially available. Noise suppressor 10 can be used in conjunction with a number of types of firearms, including without limitation 223 caliber, 5.56 mm rifles.

The embodiment of noise suppressor 10 set forth in FIG. 1-3 and described above offer a number of advantages. Because the majority of the components of noise suppressor 10 are made from a material comprising titanium, noise suppressor 10 is lighter than other similar sized suppressors made primarily from heavier materials such as stainless steel. However, by manufacturing first baffle 32 and second baffle 40 from a material comprising stainless steel, noise suppressor 10 has sufficient strength toward the front end of noise suppressor 10 where the high-pressure pulse of hot gases from the firing of the projectile is most significant. In addition, where adjoining components of noise suppressor 10 are made from dissimilar materials, the embodiment of noise suppressor 10 provides for threaded interfaces instead of welded or press fit interfaces or components simply held together by the outer tube and end caps. The threaded interfaces ensure that adjoining components made from dissimilar materials do not come loose during use of noise suppressor 10. Therefore, noise suppressor 10 provides a lighter and more durable noise suppressor, which effectively suppresses muzzle blast and maintains the accuracy of the firearm.

Figure 4:
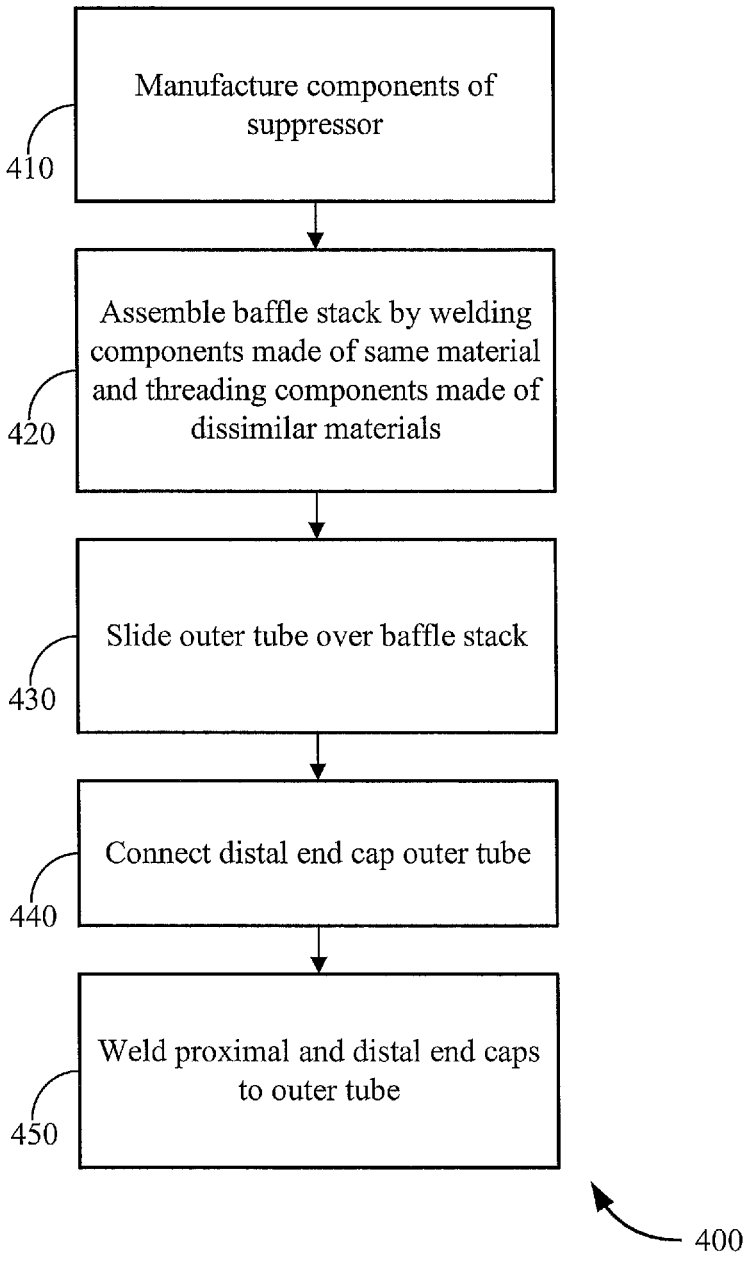
FIG. 4 is a block diagram showing an embodiment of a method of manufacturing and assembling the present invention.

FIG. 4 of method 400 is a block diagram depicting certain embodiments concerning methods of manufacturing and assembling noise suppressor 10. In block 410, components are manufactured using materials to optimize the weight, strength, and durability of components of noise suppressor 10, including outer tube, end caps, and baffles. In a particular embodiment of noise suppressor 10, proximal end cap 16, distal end cap 20, outer tube 22, third baffle 50, fourth baffle 58, fifth baffle 66, and sixth baffle 74 are made of titanium grade 2. First baffle 32 and second baffle 40 are made of 316 stainless steel. Components that are to be connected to other components that are made of dissimilar materials are designed with threaded interfaces. Components that are to be connected to other components made of same material are designed with welded interfaces. Using this particular configuration of components results in a lightweight suppressor, which possesses necessary strength towards the front portion of the suppressor and maintains the accuracy of the firearm.

In block 420, the baffle stack assembled with components made of dissimilar materials connected using threaded interfaces and components made of the same materials connected using welded interfaces. In this particular embodiment, the baffles stack comprising proximal end cap 16, first baffle 32, second baffle 40, third baffle 50, fourth baffle 58, fifth baffle 66, and sixth baffle 74 is assembled. Proximal end cap 16 with threaded interface 30 is connected to first baffle 32 with threaded interface 38. Second baffle 40 is connected to the distal end of first baffle 32 with welded interface 46. Third baffle 50 with threaded interface 56 is connected to second baffle 40 with threaded interface 48. Fourth baffle 58 is connected to the distal end of third baffle 50 with welded interface 64. Fifth baffle 66 is connected to the distal end of fourth baffle 58 with welded interface 72. Sixth baffle 74 is connected to the distal end of fifth baffle 66 with welded interface 78.

In block 430, the outer tube is connected to the baffle stack. In this particular embodiment, outer tube 22 is slid over the baffle stack and abuts with interface 24 of proximal end cap 16. In block 440, the distal end cap is secured to the baffle stack and outer tube. In this particular embodiment, distal end cap 20 is connected to the outer tube 22 and baffle stack. In block 450, the outer tube is secured to the end caps. In this particular embodiment, outer tube 22 is secured to proximal end cap 16 and distal end cap 20 with welded interface 24 and 26 as shown in more detail in FIG. 1.

Moreover, while the methods described herein are described in a particular order for ease of description, unless the context dictates otherwise, various procedures may be reordered, added, and/or omitted in accordance with various embodiments. Moreover, the procedures described with respect to one method may be incorporated within other described methods. In addition, while various embodiments of apparatus are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A suppressor for a firearm comprising:

a central axis;

an outer tube made of a material comprising titanium and comprising a proximal end and a distal end;

a proximal end cap wherein the proximal end cap comprises:

a material comprising titanium;

a first interface to attach the proximal end cap to the outer tube;

a proximal end adapted to be coupled to a firearm;

a second interface that is threaded and located at the distal end of the proximal end cap; and a bore aligned with the central axis;

a plurality of baffles comprising:

a first baffle wherein the first baffle comprises:

a material comprising stainless steel;

a proximal end;

a distal end;

a substantially hemispherical dome at the proximal end of the first baffle;

a bore in the substantially hemispherical dome of the first baffle aligned with the central axis;

a spacer at the distal end of the first baffle; and a third interface that is threaded and located between the hemispherical dome and spacer wherein the third interface engages with the second interface to couple the first baffle to the proximal end cap;

a second baffle wherein the second baffle comprises:

a material comprising stainless steel;

a proximal end;

a distal end;

a substantially hemispherical dome at the proximal end of the second baffle;

a bore in the substantially hemispherical dome of the second baffle aligned with the central axis;

a spacer at the distal end of the second baffle;

a fourth interface located between the hemispherical dome and spacer of the second baffle wherein the fourth interface is connected to the distal end of the first baffle;

a fifth interface that is threaded and located at the distal end of the second baffle;

a third baffle wherein the third baffle comprises:

a material comprising titanium;

a proximal end;

a distal end;

a substantially hemispherical dome at the proximal end of the third baffle;

a bore in the substantially hemispherical dome of the third baffle aligned with the central axis;

a spacer at the distal end of the third baffle; and a sixth interface located between the hemispherical dome and spacer of the third baffle wherein the sixth interface engages with the fifth interface to couple the third baffle to the second baffle;

a distal end cap wherein the distal end cap comprises:

a material comprising titanium a bore aligned with the central axis; and a seventh interface wherein the seventh interface is connected to the distal end of the outer tube.

2. The suppressor of claim 1, wherein the material comprising titanium is grade 2 titanium.

3. The suppressor of claim 1, wherein the material comprising titanium is grade 5 titanium.

4. The suppressor of claim 1, wherein the material comprising stainless steel is type 316 stainless steel.

5. A suppressor for a firearm comprising:

a proximal end adapted to be coupled to a firearm;

a distal end opposite the proximal end;

a central axis aligned with a bore of the firearm;

a first component made of a first material;

a second component made of a second material, the second material being different from the first material; and wherein each of the first and second components comprises a bore aligned with the central axis and a threaded interface, and wherein the threaded interface of the first component engages with the threaded interface of the second component to couple the first component with the second component.

6. The suppressor of claim 5, wherein the first component is a proximal end cap and the second component is a baffle.

7. The suppressor claim 5, wherein the first component is a first baffle and the second component is a second baffle.

8. The suppressor of claim 5, wherein the first component is made of a material comprising titanium and the second component is made of a material comprising stainless steel.

9. The suppressor of claim 8, wherein the titanium is grade 2 titanium.

10. The suppressor of claim 8, wherein the titanium is grade 5 titanium.

11. The suppressor of claim 8, wherein the stainless steel is type 316 stainless steel.

12. The suppressor of claim 8, further comprises:

an outer tube comprising a material comprising titanium and further comprises a proximal end and a distal end;

wherein the first component is a proximal end cap that attaches to the outer tube and the threaded interface of the first component is located at the distal end of the proximal end cap; and wherein the proximal end cap further comprises:

a proximal end adapted to be coupled to a firearm, and a bore aligned with the central axis.

13. The suppressor of claim 12, wherein the second component is a first baffle further comprising:

a proximal end;

a distal end; and a bore at the proximal end of the first baffle aligned with the central axis.

14. The suppressor of claim 13, further comprising:

a second baffle wherein the second baffle comprises:

a material comprising stainless steel;

a proximal end;

a distal end;

a bore at the proximal end of the second baffle aligned with the central axis;

a threaded interface at the distal end; and wherein the second baffle is connected to the distal end of the first baffle.

15. The suppressor of claim 14 further comprising:

a third baffle wherein the third baffle comprises:

a material comprising titanium;

a proximal end;

a distal end;

a bore at the proximal end of the third baffle aligned with the central axis; and a threaded interface wherein the threaded interface of the third baffle engages with the threaded interface at the distal end of the second baffle to couple the second baffle to the third baffle.

16. The suppressor of claim 15 further comprising:

a distal end cap wherein the distal end cap comprises:

a material comprising titanium; and an interface wherein the interface of the distal end cap attaches to the distal end of the outer tube.

17. A method of manufacturing a suppressor for a firearm, the method comprising:

manufacturing an outer tube from a material comprising titanium wherein the outer tube comprises a proximal end and a distal end;

manufacturing a proximal end cap from a material comprising titanium wherein the proximal end cap comprises:

a proximal end adapted to be coupled to a firearm;

a first interface that is threaded and located at the distal end of the proximal end cap; and a bore aligned with a central axis of the suppressor;

manufacturing a first baffle from a material comprising stainless steel wherein the first baffle comprises:

a proximal end;

a distal end;

a substantially hemispherical dome at the proximal end of the first baffle;

a bore in the substantially hemispherical dome of the first baffle aligned with the central axis of the suppressor;

a spacer at the distal end of the first baffle; and a second interface that is threaded and located between the hemispherical dome and spacer;

manufacturing a second baffle from a material comprising stainless steel wherein the second baffle comprises:

a proximal end;

a distal end;

a substantially hemispherical dome at the proximal end of the second baffle;

a bore in the substantially hemispherical dome of the second baffle aligned with the central axis of the suppressor;

a spacer at the distal end of the second baffle;

a third interface located between the hemispherical dome and spacer of the second baffle;

a fourth interface that is threaded and located at the distal end;

manufacturing a third baffle from a material comprising titanium wherein the third baffle comprises:

a proximal end;

a distal end;

a substantially hemispherical dome at the proximal end of the third baffle;

a bore in the substantially hemispherical dome of the third baffle aligned with the central axis of the suppressor;

a spacer at the distal end of the third baffle; and a fifth interface that is threaded and located between the hemispherical dome and spacer of the third baffle;

manufacturing a distal end cap from a material comprising titanium wherein the distal end cap comprises:

a bore aligned with the central axis of the suppressor; and a sixth interface wherein the sixth interface attaches to the distal end of the outer tube;

attaching the first interface to the second interface;

welding the three interface to the distal end of the first baffle;

attaching the fourth interface to the to the fifth interface;

welding the outer tube to the proximal end cap; and welding the outer tube to the distal end cap.

* * * * *